United States Patent [19]

Titus

[11] Patent Number: 5,069,298

[45] Date of Patent: Dec. 3, 1991

[54] WELL DRILLING ASSEMBLY

[76] Inventor: Charles H. Titus, 323 Echo Valley La., Newtown Square, Pa. 19073

[21] Appl. No.: 516,151

[22] Filed: Apr. 30, 1990

[51] Int. Cl.[5] ..... E21B 4/02

[52] U.S. Cl. ..... 175/107; 175/324; 384/453; 384/480

[58] Field of Search ..... 175/107, 227, 320, 324; 384/453, 484, 480; 415/903

[56] References Cited

U.S. PATENT DOCUMENTS

| | | | |
|---|---|---|---|
| 1,722,489 | 7/1929 | Bott | 384/480 |
| 3,971,450 | 7/1976 | Fox | 415/903 X |
| 4,019,591 | 4/1977 | Fox | 175/107 |
| 4,256,189 | 3/1981 | Fox et al. | 175/40 |
| 4,260,032 | 4/1981 | Fox | 175/107 |
| 4,260,167 | 4/1981 | Fox | 277/135 |
| 4,284,149 | 8/1981 | Fox | 175/40 |
| 4,308,927 | 1/1982 | Fox | 175/107 |
| 4,324,299 | 4/1982 | Nagel | 175/107 |
| 4,361,194 | 11/1982 | Chow et al. | 175/107 |
| 4,548,283 | 10/1985 | Young | 175/107 |
| 4,593,774 | 6/1986 | Lingafelter | 175/107 |
| 4,683,964 | 8/1987 | Wenzel | 175/107 |

*Primary Examiner*—Hoang C. Dang

*Attorney, Agent, or Firm*—Dann, Dorfman, Herrell and Skillman

[57] ABSTRACT

A well drilling assembly including a drill bit projecting beyond the bottom of a hollow casing at the bottom of the hole. A fluid motor mounted in the casing has a rotary shaft to rotate the drill bit. The lower end of the rotary shaft is hollow to provide a central flow passage therein, and has an outer pressure diameter less than the inner diameter of said casing to provide an outer pressure passage therealong. Bearings are mounted in the outer passage to support the shaft against radial and axial displacement, and are engulfed in a body of lubricant confined between upper and lower floating seals which limit flow of drilling mud into the lubricant and flow of lubricant from the body into the drilling mud. A labyrinth provides a rotating orifice in the outer passage below the lower seals to maintain a pressure differential between the exterior of said drill bit and the lower seals.

2 Claims, 3 Drawing Sheets

WELL DRILLING ASSEMBLY

FIELD OF THE INVENTION

The present invention relates to well drilling and is particularly applicable to an assembly for use in drilling wells in which the drive motor for rotating the drill is positioned adjacent the lower end of the drill string.

BACKGROUND OF THE INVENTION

In drilling wells, a hollow tubular drill string is introduced into the well. Adjacent the bottom of the drill string, a drill tool casing houses a drive motor which rotates a central shaft which projects beyond the drill tool casing and mounts a drill bit. Rotation of the drill bit extends the length of the well as the drill tool casing is advanced incrementally.

The drive motor for the drill shaft may be hydraulic or pneumatic, of the positive displacement (PDM) or turbine type mounted within the drill tool casing. Conventionally, the motor is driven by forcing air or drilling mud through the casing and the motor. Drilling mud may consist of clay, water and/or oil, weighting material such as barium sulfate or hematite, sand, quartz, various types of pulverized, granulated or chips of abrasive material, and chemical polymers. Most frequently, drilling mud is pumped from the surface and through the drill string into the drill tool casing so that it fills the interior of the drill tool casing and the well annulus. The mud is formulated such that it exerts an isostatic pressure which increases on the order of 0.5–1.0 pounds per square inch per foot of depth in the well so that the isostatic pressure may be comparable to subterranean pressure at the bottom of the well in order to prevent well collapse. Thus, at the bottom of a 15,000-foot well, the pressure in the drilling mud may be 15,000 psi. The mud within the drill tool casing is used to drive the fluid motor, and the mud exhausted from the motor is directed through nozzles in the drill bit so as to expel chips and other material disintegrated by the drill bit and also to provide a coolant for cooling the cutting surfaces of the drill bit to improve its cutting efficiency. The pump is normally at the surface adjacent the well, and supplies mud at a pressure sufficient to overcome the pressure drop due to friction of the mud flowing through the drill string. This pressure is further elevated above isostatic pressure so as to drive the motor when its outlet is at isostatic pressure plus the pressure required to exhaust the mud through the nozzles in the drill bit.

The drill bit drills a well hole which is larger in diameter than the outside diameter of the drill tool casing so that an annular space is provided between the drill tool casing and the sides of the well hole through which the casing is advanced during the drilling operation. The drilling mud is exhausted into this annular space and carries with it chips and other drilling debris dislodged by the drill. The added surface hydraulic pressure of the drilling mud forces the spent drilling mud upwardly through the annular space around the drill tool casing and along the entire length of the drill string to the surface for filtration and recycling. Thus, while the pressure gradient in the drilling mud within the well bore provides increasing pressures along the drill string to the lower depths of the well, the pump at the surface supplies the effective operating pressure within the drill casing at the inlet of the fluid motor. While the differential pressure across the motor may represent a pressure loss in the range of 300 to 1500 psi, there is no significant pressure loss along the length of the bore in the rotary drill shaft within the casing. There is another pressure loss of 500–1500 psi through the nozzles in the drill bit and a gradual diminishing of the pressure as the drilling mud flows upwardly around the drill casing and along the remainder of the drill string for recycling to the pump for returning the drilling mud to the fluid motor.

In recycling the drilling mud, the larger particles of drilling debris are filtered from the mud in filters and settling tanks, but the constituents of the drilling mud themselves may still have high abrasive character. Although it is possible to design the fluid motor to withstand the flow of abrasive drilling mud through the motor, the bearing devices which center the rotary shaft within the drill tool casing are simultaneously subject to large fluctuating axial and radial mechanical forcers and severe abrasion by the drilling mud. Conventional long-life sealed lubricated bearings are not available for use in an environment where the pressures may vary from atmospheric to more than 20,000 psi, and where the pressure medium is an abrasive fluid such as drilling mud. Substantial down time and cost is required to withdraw the drilling string from the drill hole for maintenance operations upon the motor, the bearing assembly, and the associated drill bit.

Prior to the present invention, the bearings associated with positive displacement motors and turbines were replaced frequently, and the cost of replacement was considered a necessary expense which must be tolerated in any deep well drilling operation.

SUMMARY OF THE INVENTION

A primary object of the present invention is to provide a novel drilling assembly for positioning within the well hole, in which a hollow rotary shaft for mounting the drill bit is mounted in a drill tool casing for rotation against axial or radial displacement.

More specifically, the present invention provides a well drilling assembly having bearings mounting a rotary shaft for the drill bit within the bearing assembly casing so as to provide a body of lubricating fluid surrounding the bearings so that the body of fluid is maintained under an isostatic pressure comparable to the pressure of the drilling mud within the casing at that location, minimizing intermingling of the drilling mud and lubricating fluid.

The present invention also provides improved means for stabilizing the drill bit and guarding against the drilling mud bypassing the drill bit in the vicinity of the bearing assembly from the interior of the hollow rotary shaft to the exterior of the drill tool casing.

All of the objects of the invention are more fully set forth hereinafter with reference to the accompanying drawings.

BRIEF DESCRIPTION OF THE DRAWINGS

In the attached drawings.

DESCRIPTION OF THE PREFERRED EMBODIMENT

Figure 1:
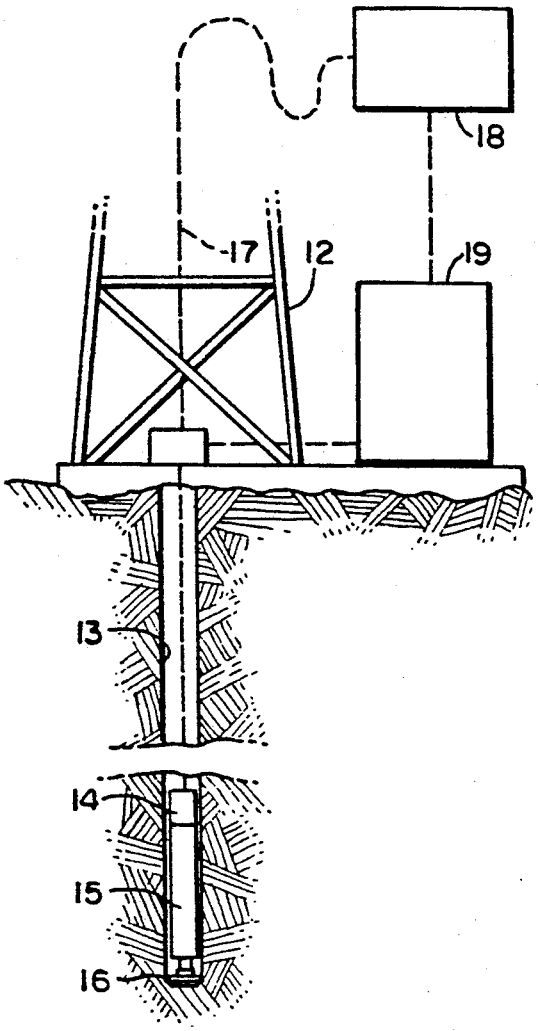
FIG. 1 is a thumbnail sketch of a drilling rig embodying the present invention.
Figure 2:
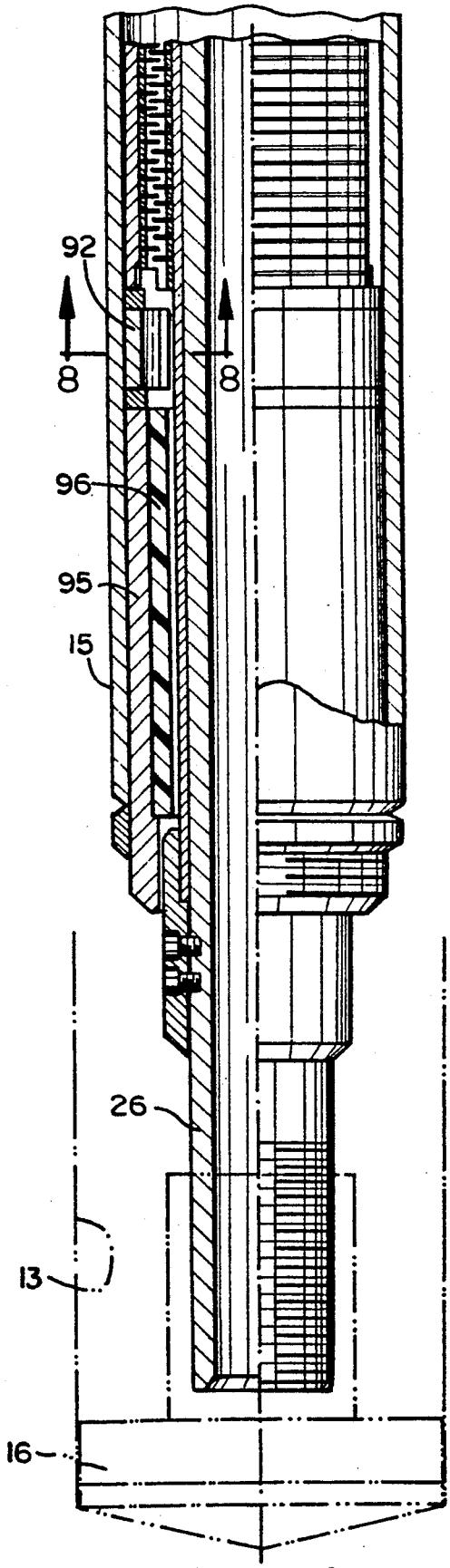
FIGS. 2–5 are fragmentary views, partially in section, of consecutive portions of a drilling assembly embodied in the drilling rig of FIG. 1.

The drilling assembly is illustrated diagrammatically in FIG. 1, wherein the well superstructure 12 is positioned over the well hole 13 to support a drill string 17 which is fed into the well. At the bottom of the drill string 17, are a motor casing 14 and a bearing assembly casing 15, at the lower end of which a drill bit shown diagrammatically at 16 projects downwardly to perform the drilling operation. The motor casing 15 mounts a fluid motor, in the present case a turbine (not shown), for rotating the drill bit 16. The turbine is driven by drilling mud which is introduced to the turbine through a conduit in the drill string 17 fed from a pump 18. The drilling mud is forced through the turbine to rotate the drill bit 16, and the discharge from the turbine is forced through the drill bit to assist in discharging drilling debris, to lubricate the drill bit, and to provide a cooling fluid to maintain the temperature of the drill bit at a suitable level. The drilling mud forced through the drill bit is discharged into the well hole 13 and flows upwardly around the casings 14 and 15 and the drill string 17 and is discharged from the top of the well hole 13. The spent drilling mud is captured and recycled to the pump through suitable filtration apparatus 19 which conventionally includes shaker screen filters and settling tanks to remove drilling debris which is entrained in the spent drilling mud.

Figure 5:
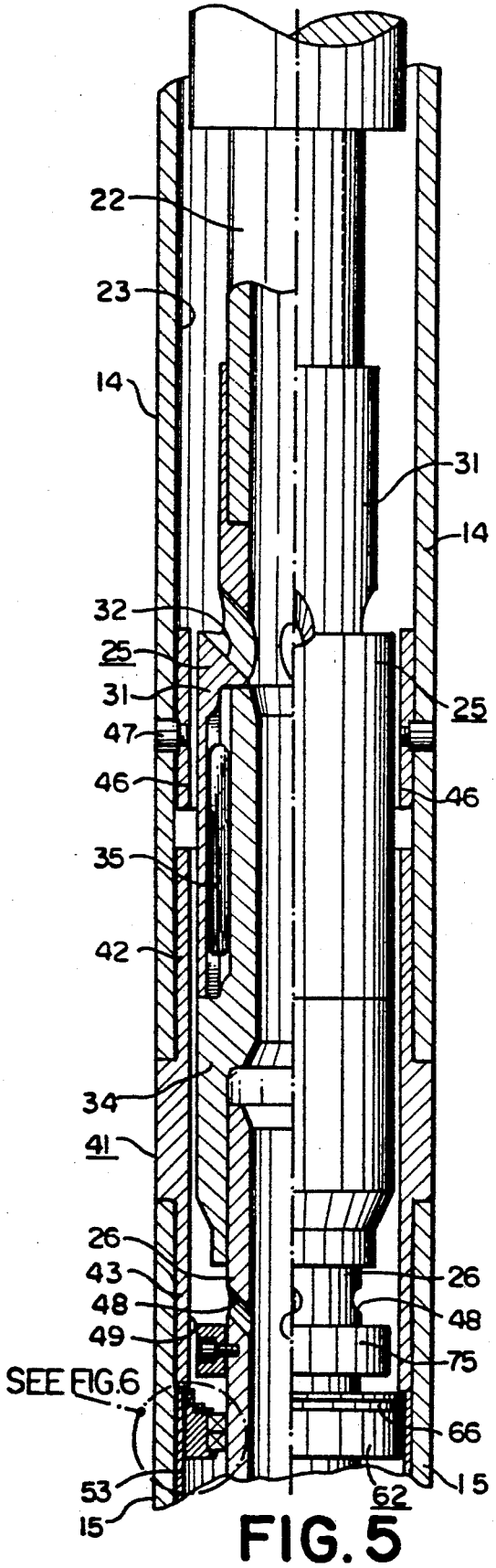

The turbine is mounted in the motor casing 14, and, as shown in FIG. 5, the turbine has a drive shaft 22 projecting downwardly coaxially within the casing driven by the turbine rotor at a rotary speed in the range of 50 to 1000 rpm, depending upon the character of the subterranean formations and the type of drill bit used. Drilling mud is discharged from the turbine into the annular space 23 surrounding the turbine rotary shaft 22 at a volumetric flow on the order of 200 to 600 gallons per minute.

A bearing assembly casing 15 is connected to the motor casing 14, and houses a hollow drive shaft 26 which is connected to the bottom of the rotor shaft 22 by a coupler 25. The hollow drive shaft 26 extends throughout the length of the bearing assembly casing 15, as shown in FIGS. 5, 4, 3 and 2 and mounts the drill bit 16 at its lower end. The coupler 25 comprises a nipple 31 attached to the drive shaft, and a hollow connector 34 which is keyed to the nipple 31 as indicated at 35 and is secured at its lower end to the upper end of the drill shaft 26. The lower end of the nipple 31 has an outside diameter substantially equal to the outer diameter of the connector element 34, and these diameters are sufficiently small to permit rotation of the coupler 25 within the motor casing 14. The motor casing 14 is securely connected to the bearing assembly casing 15 by a joint 41 to enable disassembly of the casings to gain access to the coupler 25. In the present instance, the joint 41 comprises a hollow tubular member having upper and lower portions 42 and 43 telescopically engaged within the casings 14 and 15 above and below the joint. Suitable seals (not shown) are provided between the joint 41 and the casings 14 and 15 to prevent escape of drilling mud from the interior of the casings.

Above the joint 41, a guide bushing 46 is mounted within the casing 15 by plugs 47 which project through the casing wall and engage in the hollow bushing 46 to anchor the same in position within the casing 15. The bushing 46 has a sliding fit with the interior of the casing 14 and the plugs 47 are sealed to prevent the escape of drilling mud around the bushing. The bushing 46 cooperates with ports 32 in the upper part 31 of the coupler 25 to assist in directing the drilling mud into the hollow interior of the coupler 25 which serves as a flow passage for the mud. The bushing 46 closely surrounds the upper part 31 of the coupling so as to impede the flow of drilling mud around the coupler and to reduce the pressure of the drilling mud in the pressure passage space 23 in the area of the joint 41. The ports 32 are directed angularly downwardly and inwardly as shown in FIG. 5 to provide an interconnection between the pressure passage 23 and the flow passage in the bore of the coupler 25.

The top end of the hollow shaft 26 is mounted in the lower element 34 of the coupler 25 so that its hollow bore is in longitudinal alignment with the hollow bore of the coupler 25. A similar interconnection is provided below the joint 41 and the coupler 25 at 48 between the hollow interior of the shaft 26 and the annular space 49 between the shaft 26 and the casing 15. Like the port 32, the interconnection 48 is inclined downwardly and inwardly between the space 49 and the hollow interior of the shaft 26.

Figure 3:
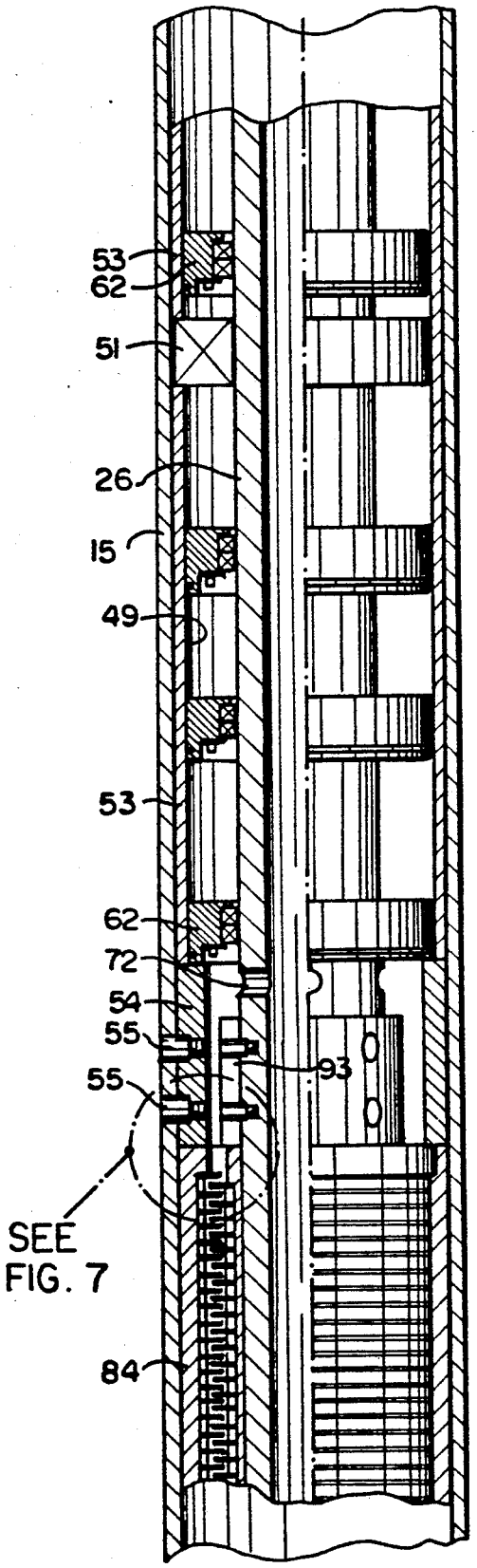
Figure 4:
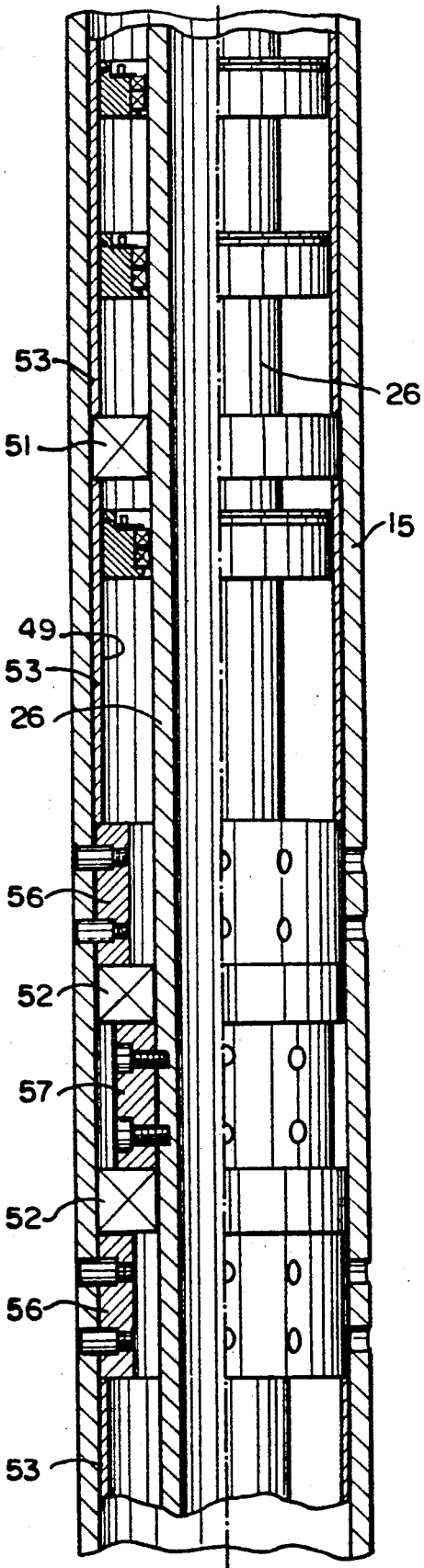

As shown in FIGS. 3 and 4, the shaft 26 is supported for rotation within the casing 15 by radial bearings 51 and axial thrust bearings 52. The present invention enables the use of standard, off-the-shelf bearings which may be selected according to the operating parameters of the particular drill bit. In the illustrated embodiment of the invention, the radial bearings 51 are spaced apart along the length of the tool casing 15 and two thrust bearings 52 are positioned centrally between the radial bearings 51. The bearings may be single- or multi-race, may be roller or ball, and may be self-aligning spherical or tapered, depending upon the design parameters selected in accordance with the operating conditions within the well hole. The radial bearings 51 are positioned in the casing 15 by thin sleeves 53 which engage axially against the outer races of the bearings. In the present instance, the inner races of the radial bearings may be displaced axially on the shaft 26 to accommodate deflections which may occur during drilling operations. At the upper end of the bearing assembly, the upper sleeve 53 engages the lower end of the coupler 43 and at the lower end, the lower sleeve 53 engages a mounting ring 54 positioned in the casing 15 by anchoring plugs 55. Between the radial bearings 51, the thrust bearings 52 are mounted between bearing rings 56 anchored in the casing 51 and a central positioning ring 57 anchored on the drill shaft 26. The bearings mounted between the shaft and the casing accommodate the impacts imparted by the drill bit engaging subterranean formations and the myriad forces applied to the shaft 26 during the drilling operations.

In accordance with the invention, the use of standard bearings is enabled by reason of the novel sealing arrangement provided by the present invention. The sealing arrangement enables the bearings 51 and 52 to be engulfed in a body of lubricant which is confined in the annular space providing a pressure passage 49 between the outside of the shaft 26 and the interior wall of the casing 15. The lubricant may be oil or grease, or any suitable fluent material which is effective to lubricate the bearings under the conditions extant in the drill hole. The lubricant is confined to the pressure-passage space 49 by multiple floating seals 62 which are operable to be displaced along the length of the tubular members 53. In the present instance, there are three floating seals above the upper radial bearing 51, a single floating seal between the upper bearing 51 and the thrust bearings 52, a single seal below the thrust bearings 52 and above the lower radial bearing 51 and three seals below the lower radial bearing 51. The seals are identical and comprise a support ring 65 adapted to slide longitudinally within tubular positioning sleeve 53. The ring is axially elongated to enable longitudinal sliding movement without cocking. The outer surface has an O-ring seal 66 adjacent the end which confronts the drilling mud and remote from the end which confronts the lubricant. On the inside of the ring 62, a packing ring 67 is carried and anchored in place by an anchor element 68. In the present instance, the packing ring comprises elastomeric sealing gaskets is confined between a pair of angular support rings 69 to enable the anchor element 68 to compress the sealing gaskets 67 against the outer wall of the rotary shaft 26. The shape and composition of the packing 67 may be selected in accordance with the operating conditions within the well hole, for example as determined by the subterranean temperature in the hole, the composition of the drilling mud, the nature of the material being drilled, etc.

In order to minimize the tendency of the drilling mud to infiltrate the body of lubricant engulfing the bearings, and escape of the lubricant from the space 49 into the drilling mud, means is provided to assure a substantial balance of pressure on opposite sides of the seals 62. To this end, a second interconnection between the flow passage in the interior of the drill shaft 26 and the pressure passage in the annular space 49, is provided at 72 below the lowermost seal 62. In the present instance, the interconnection 72 comprises a plurality of radial passageways through the wall of the hollow shaft 26. Thus, the interconnections at 72 and 48 transmit the isostatic pressure of the drilling mud within the center of the hollow shaft 26 to the annular space 49 above the uppermost floating seal 62 and the space 49 below the lowermost seal 62. The pressure differential between the interconnections 48 and 72 is insubstantial so that the body of lubricant between the uppermost and lowermost seals 62 is subject to the same isostatic pressure as the drilling mud. The floating nature of the seals 62 permits the assembly to accommodate to the deflections, impacts and vibrations inherent in the operation of the drill, and as the lubricant migrates out of the pressure-passage space between the uppermost and lowermost seals, these seals approach one another to reduce the space and minimize infiltration of drilling mud into the space to replace the lubricant.

It is expected that in normal operation, the drilling mud will eventually infiltrate the space between the seals, but the use of multiple seals will inhibit the travel of the mud. The contamination of the body of lubricant with drilling mud will be concentrated at the opposite ends of the bearing assembly, and the contamination of the lubricant will reach the radial bearings long before it progresses beyond the innermost floating seals where it may contaminate the body of lubricant engulfing the thrust bearings. Inasmuch as the thrust bearings are subject to the greatest forces, their operating life is substantially prolonged by reason of the delay in permitting contamination of the lubricant in which the thrust bearings operate.

Figure 6:
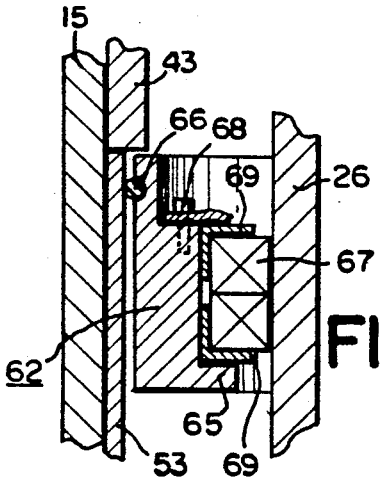
FIG. 6 is an enlarged view of a portion of the assembly embodying a floating seal encircled at 6 in FIG. 5.
Figure 7:
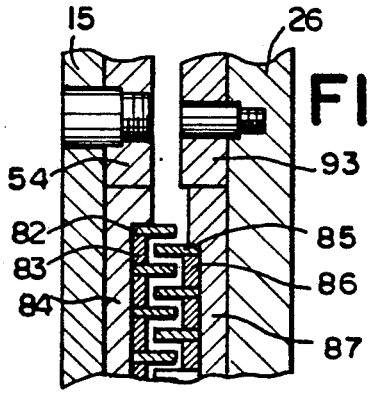
FIG. 7 is an enlarged view of a portion of the assembly embodying a labyrinth encircled by broken lines in FIG. 3.

In order to further inhibit the migration of drilling mud into the uppermost seal, a guard ring 75 is mounted on the outside of the shaft 26 immediately below the interconnection 48. The guard ring is positioned to intercept any downward stream of drilling mud which may flow in the pressure passage between the joint 41 and the coupler 34 and assist in diverting any flow of drilling mud inwardly to the center flow passage of the shaft 26. As shown in FIG. 6, the thickness of the tubular positioning sleeve 53 is significantly less than the thickness of the lower telescoping part 43 of the joint 41 so that the lower end of the joint 43 provides an abutment which prevents the outer seal 66 of the sealing member 62 from sliding off the tubular member 53. The inner wall of the tubular member is provided with a finish which enhances the floating displacement of the seal member 62 along its length. At the other end of the sealing assembly, the lowermost seal 62 abuts against the mounting ring 54 to maintain its outer seal element in sliding engagement with the interior wall of the lowermost positioning sleeve 53.

Figure 8:
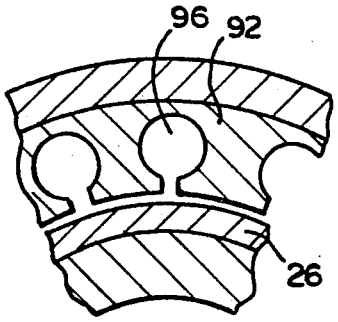
FIG. 8 is an enlarged fragmentary sectional view taken on the line 8—8 of FIG. 2.

A rotating orifice is provided between the lower seal 62 and the bottom of the casing 15 so as to enable the isostatic pressure on the lower seals to be maintained elevated above the pressure of the drilling mud on the outside of the lower end of the casing. In the present instance, the rotating orifice is provided by a labyrinth formed by a plurality of inwardly-projecting flanges and spacers 82 and 83 mounted in an outer shell 84 and a like number of outwardly-projecting flanges and spacers 85 and 86 mounted in an inner shell 87. The outer shell 84 is positioned between the mounting ring 54 adjacent the lowermost seal 62 on the upper side and a guide ring 92 below the labyrinth. The inner shell is positioned between an upper guide ring 93 and the guide ring 92. As shown in FIG. 8, the lower guide ring 92 serves as a guide ring for the lower end of the shaft 26 and has key-hole shaped through-passages 96 which enable flushing of any particles that might become entrained between the shaft 26 and the guide 92. Below the guide ring 92, a conventional guide bushing 95 is provided with an elastomeric liner 96 to provide lateral guidance for the shaft within the lower end of the casing 15. The labyrinth 82–87, the ring 92 and the bushing 95 provides a rotating orifice means to maintain a pressure differential within the pressure passage in the casing 15 outside of the tool shaft 26. The pressure differential corresponds to the pressure drop in the flow of drilling mud through the drill bit 16, and enables the lubricant in the sealing assembly to be maintained at a pressure comparable to the pressure of the sealing mud within the flow passage of the drill shaft 25.

While a particular embodiment of the present invention has been herein illustrated and described, it is not intended to limit the invention to such disclosure, but changes and modifications may be made therein and thereto within the scope of the following claims.

I claim:

1. In a drilling assembly comprising a drill bit operable to be rotated to produce a well hole of a given diameter, a hollow casing having an interior cylindrical surface at its lower end at a level spaced above the drill bit at the bottom of the hole, an upright rotary shaft mounted concentrically within the cylindrical surface in the lower end of said casing and projecting downwardly therefrom at its lower end to rotate the drill bit, rotary drive means mounted adjacent the upper end of said casing above said drill bit and drivingly connected to the upper end of said rotary shaft, said shaft providing flow passages for directing drilling mud to said drill bit, and supply means to supply drilling mud to said drive means to rotate the rotary shaft, said drive means operating to discharge drilling mud into said flow passages, said discharged mud being ejected through said drill bit to entrain drilling debris and being carried out of the hole by upward flow outside of said casing; the improvement wherein the lower end of the rotary shaft is hollow to define said flow passage centrally therein, and has an outer cylindrical surface parallel to the interior surface of said casing and an outer diameter less than the inner diameter of said casing to provide an outer pressure passage along the outer cylindrical surface thereof, said flow and pressure passages having upper and lower interconnections at spaced upper and lower locations along the shaft respectively, the lower end of the flow passage being in fluid communication with the interior of said drill bit, and the lower end of the pressure passage being in fluid communication with the exterior of said drill bit and with the outside of said casing, upper and lower radial and thrust bearings in said pressure passage between said upper and lower interconnections and above the lower end, said bearings supporting said rotary shaft in said casing against radial and axial displacement relative to said casing, said upper radial bearing being above said upper thrust bearing and said lower radial bearing being below said lower thrust bearing, a selected volume of lubricant in said pressure passage between said shaft and said casing forming a body of lubricant engulfing said bearing, upper and lower seals between said body and said interconnections to limit flow of drilling mud into said body of lubricant, and flow of lubricant from said body toward said interconnections, each said seal comprising a plurality of axially-elongated rings mounted between said interior circumferential surface and said outer cylindrical surface and slidable longitudinally therealong, each said ring having an outer sealing element about its outer periphery adjacent one transverse end surface of the ring in sealing engagement with said interior surface of the casing, and having packing elements spaced axially from said outer sealing element around the inner periphery of said ring in sealing engagement with said outer surface of the shaft, whereby said rings may float longitudinally of said rotary shaft relative to each other and relative to said interconnections and said bearing while maintaining a sealed transverse barrier across the pressure passage between said outer surface of said shaft and the interior surface of said casing, each ring having said one transverse end surface directed toward one of said interconnections and the other transverse end surface directed toward one of said bearings, one plurality of said rings being spaced apart from one another in the space between said upper connection and said upper radial bearing means, and a second plurality of said rings being spaced apart from one another in the space between said lower interconnection and said lower radial thrust bearings, and a labyrinth providing a rotating orifice in said pressure passage between the lower interconnection and the lower end of the casing to maintain a pressure differential between the exterior of said drill bit and said lower seal.

2. A drilling assembly according to claim 1 including additional sealing devices in said pressure passage between said upper radial bearing means and said axial thrust bearing means and between said axial thrust bearing means and said lower radial bearing means.

* * * * *